US008979961B2

(12) United States Patent
Schultink et al.

(10) Patent No.: US 8,979,961 B2
(45) **Date of Patent: *Mar. 17, 2015**

(54) VACUUM CLEANER FILTER BAG

(75) Inventors: Jan Schultink, Overpelt (BE); Ralf Sauer, Overpelt (BE)

(73) Assignee: Eurofilters Holding N.V., Overpelt (BE)

( * ) Notice: Subject to any disclaimer, the term of this patent is extended or adjusted under 35 U.S.C. 154(b) by 110 days.

This patent is subject to a terminal disclaimer.

(21) Appl. No.: 13/502,176

(22) PCT Filed: Sep. 21, 2010

(86) PCT No.: PCT/EP2010/005779

§ 371 (c)(1),
(2), (4) Date: May 11, 2012

(87) PCT Pub. No.: WO2011/047765

PCT Pub. Date: Apr. 28, 2011

(65) Prior Publication Data

US 2012/0216493 A1 Aug. 30, 2012

(30) Foreign Application Priority Data

Oct. 19, 2009 (EP) ..... 09013176

(51) Int. Cl.
*B01D 46/00* (2006.01)
*A47L 9/14* (2006.01)

(52) U.S. Cl.
CPC ..... *A47L 9/14* (2013.01)
USPC ..... 55/382; 55/361; 55/486; 55/487; 55/527; 55/528; 95/57; 95/78; 95/287

(58) Field of Classification Search
CPC ..... B01D 39/00
USPC ..... 55/361, 382, 486–487, DIG. 2, DIG. 39, 55/527–528; 95/57, 78, 287; 96/15, 69
See application file for complete search history.

(56) References Cited

U.S. PATENT DOCUMENTS

| | | | | |
|---|---|---|---|---|
| 4,589,894 | A | 5/1986 | Gin et al. | |
| 5,080,702 | A | 1/1992 | Bosses | |
| 5,401,446 | A * | 3/1995 | Tsai et al. | 264/484 |
| 5,647,881 | A | 7/1997 | Zhang et al. | |
| 6,207,601 | B1 | 3/2001 | Maurer et al. | |
| 2010/0212273 | A1 * | 8/2010 | Schultink et al. | 55/382 |

FOREIGN PATENT DOCUMENTS

| | | |
|---|---|---|
| DE | 7424655 | 10/1974 |
| DE | 19544790 | 11/1995 |
| DE | 19919809 | 4/1999 |
| DE | 10064608 A1 | 4/2002 |

(Continued)

OTHER PUBLICATIONS

International Search Report completed Jan. 3, 2011 for International Application No. PCT/EP2010/005779.

*Primary Examiner* — Jason M Greene
*Assistant Examiner* — Karla Hawkins
(74) *Attorney, Agent, or Firm* — Brinks Gilson & Lione

(57) ABSTRACT

The Invention relates to a vacuum cleaner filter bag comprising a bag wall, wherein the bag wall comprises precisely one nonwoven layer in the form of a melt-spur microfibrous nonwoven layer.

20 Claims, 2 Drawing Sheets

(56) References Cited

FOREIGN PATENT DOCUMENTS

Figure 1:
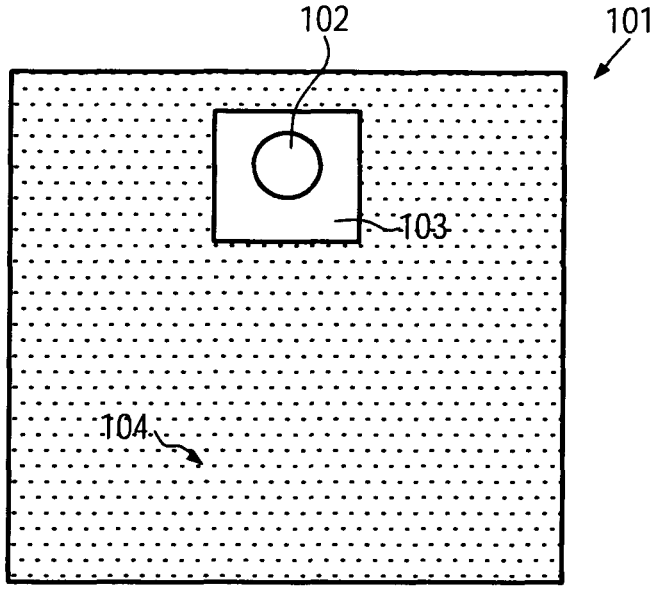

| | | | |
|---|---|---|---|
| DE | 102004020555 | | 11/2005 |
| DE | 102005059214 | | 6/2007 |
| EP | 0161790 | A2 | 11/1985 |
| EP | 0338479 | A1 | 10/1989 |
| EP | 0960645 | | 1/1999 |
| EP | 0960645 | * | 12/1999 |
| EP | 1212971 | A2 | 6/2002 |
| EP | 1795248 | | 6/2007 |
| EP | 2011555 | | 7/2009 |
| EP | 2011556 | | 7/2009 |
| WO | WO 97/33026 | | 9/1997 |
| WO | WO 2005107557 | A1 | 11/2005 |
| WO | WO 2011/047765 | A1 | 4/2011 |

* cited by examiner

VACUUM CLEANER FILTER BAG

This application claims the benefit under 35 U.S.C. §371 of International Application No. PCT/EP2010/005779, filed Sep. 21, 2010, which claims the benefit of European Patent Application No. 09013176.4, filed Oct. 19, 2009, which are incorporated by reference herein in their entirety.

The invention relates to a vacuum cleaner filter bag with a bag wall. The invention in particular relates to a disposable filter bag.

Vacuum cleaner filter bags of nonwovens usually comprise a bag wall of several filter material layers. The filter material layers can be, for example, layers of filter paper or nonwoven. To obtain the desired properties in view of filtration efficiency, dust storage capacity (capacity) and mechanical strength, different filter material layers are combined. The different filter material layers can be connected to each other or loosely lie one upon the other. The layers can be connected, for example, by gluing, welding (calendering) or needling. A multilayer filter bag is known, for example, from U.S. Pat. No. 4,589,894.

The individual filter material layers can have different functions. For example, protective layers, capacity layers, fine filter layers and reinforcement layers can be combined. As protective or reinforcement layers, thermally consolidated spunbond nonwovens (EP 0 161 790), thermally consolidated fibrous nonwovens (U.S. Pat. No. 5,647,881), nettings (EP 2 011 556 or EP 2 011 555) or perforated foils (EP 1 795 248) are used. As fine filter layers, microfibrous meltblown nonwovens (e.g. meltblown nonwovens) are employed (cf. e.g. EP 0 161 790). Nanofibrous nonwovens have been suggested as superfine filter layers (DE 199 19 809). Coarse filter layers (capacity layers) can consist of e.g. fibrous nonwovens (carded or aerodynamically laid) or filament nonwovens (EP 0 960 645), or of loose staple fibers (DE 10 2005 059 214). Foam was also suggested as material for capacity layers (DE 10 2004 020 555).

From DE 74 24 655, a dust filter consisting of two layers is known wherein one layer comprises very high air permeability and has a support function. The support material is paper with high air permeability. The second layer consists of a web, i.e. of loose and not consolidated fibers.

From DE 195 44 790, a multilayer vacuum cleaner bag with at least one layer responsible for the particle capture activity is known. DE 195 44 790 moreover declares that, if this active layer would be strong enough to withstand the stress during manufacture and use, other layers could be dispensed with.

According to the teaching of DE 195 44 790, this active layer, however, has a grammage of less than 20 g/m$^2$ and a fiber diameter of about 1 μm. With this grammage and fineness, however, a sufficiently stable material can not actually be manufactured. In operation, bags of such a material would immediately tear apart so that actually, the vacuum cleaner bags known from this document are always multilayered.

The production of multilayer vacuum cleaner filter bags from several nonwoven layers, however, is cost-intensive as production plants for most diverse methods for the manufacture of nonwoven fabrics are required.

Therefore, the object underlying the present invention is to provide a vacuum cleaner filter bag which, on the one hand, has sufficient filtration efficiency and can, on the other hand, be produced inexpensively. This object is achieved by a vacuum cleaner filter bag according to claim 1.

The invention provides a vacuum cleaner filter bag with a bag wall, the bag wall comprising precisely one nonwoven layer in the form of a meltblown nonwoven layer.

The applicants of the present invention have found that it is possible to manufacture a vacuum cleaner filter bag with precisely one nonwoven layer in the form of a meltblown nonwoven layer, that means a nonwoven layer of meltblown nonwoven having sufficient filtration efficiency. Since for the bag wall precisely one nonwoven layer, and not several nonwoven layers, is provided, no different methods for the manufacture of nonwoven fabric are required, and the connection of different nonwoven layers can be omitted. By this, the vacuum cleaner filter bag can be manufactured at lower costs than multilayer vacuum cleaner filter bags.

The term nonwoven (German "Vliesstoff") is used according to the definition according to ISO Standard ISO9092: 1988 or CEM Standard EN29092. In particular, the terms fibrous web or web and nonwoven fabric are defined in the field of the manufacture of nonwoven fabrics and also to be understood in the sense of the present invention as follows. For the manufacture of a nonwoven, fibers and/or filaments are used.

The loose and not yet bonded fibers and/or filaments are referred to as web or fibrous web. By a so-called web bonding step, a nonwoven is finally formed from such a fibrous web, the nonwoven having sufficient strength to be e.g. reeled up on rollers. In other words, by its consolidation, a nonwoven is embodied to be self-supporting. (Details of the use of the definitions and/or methods described herein can also be taken from the standard work "Vliesstoffe", W. Albrecht, H. Fuchs, W. Kittelmann, Wiley-VCH, 2000.)

The nonwoven layer corresponds to a layer of a nonwoven fabric which is an extrusion nonwoven, that is a meltblown nonwoven.

So, the nonwoven layer can be a meltblown nonwoven layer.

The bag wall can in particular comprise precisely one filter active layer, wherein the precisely one filter active layer corresponds to the nonwoven layer. Filter active layer here designates a layer relevant for filtering the air flow to be filtered. The bag wall can moreover comprise a netting. The netting can serve to design the filter bag esthetically, for example by colors. The netting can also serve to improve the stability of the filter bag. The netting can be, for example, an extruded netting or a woven netting. The netting can have a mesh size of at least 1 mm, in particular at least 3 mm.

The bag wall can consist of a nonwoven layer in the form of a meltblown nonwoven layer. In other words, the vacuum cleaner filter bag can be a single-layer filter bag, the single layer corresponding to the nonwoven layer, that means the layer of meltblown nonwoven. In particular, no support layer or reinforcing layer is provided for the nonwoven layer in this case. In other words, the nonwoven layer can be designed such that it withstands the usual stress in manufacture and use.

The nonwoven can be a calendered nonwoven, in particular a nonwoven calendered thermally or by means of ultrasound. For thermal calendering, the initially not consolidated web can be passed between two rollers at least one of which is heated to the melting temperature of the fibers forming the web. At least one of the calender rollers can comprise elevations. By this, weld zone regions or weld points can be formed.

Ultrasonic calendering or ultrasonic consolidation is based on the conversion of electric energy into mechanical vibration energy. In the process, consolidation horns are caused to vibrate, where at the vibration points, the fibers are softened at their intersections in the web and are welded to each other. By this, weld points can be formed.

The weld points themselves can have different geometries. For example, punctiform, linear, star-shaped, circular, elliptic, square or bar-shaped welded joints can be formed.

The press area proportion of the calendered nonwoven can be 3% to 50%, in particular 10% to 30%. This means that a roller engraving used for calendering the nonwoven comprises a press area proportion of 3% to 50%, in particular 10% to 30%.

The nonwoven can comprise a number density of weld points of 5/cm$^2$ to 50/cm$^2$, in particular 15/cm$^2$ to 40/cm$^2$. The number density here designates the number of weld points per unit of area.

A nonwoven calendered in such a manner can have sufficient strength to be used as a bag wall of a vacuum cleaner filter bag.

The weld points or welded joints can be distributed uniformly, in particular at equal distances, but also non-uniformly across the complete surface of the bag wall.

The weld points can be arranged at the nonwoven in the machine direction or at an angle greater than 0° and smaller than 180° to the machine direction. In particular, the weld points can also be arranged transversely to the machine direction, that means at an angle of 90° to the machine direction.

The nonwoven layer can have a grammage of 30 g/m$^2$ to 200 g/m$^2$, in particular 40 g/m$^2$ to 150 g/m$^2$, in particular 120 g/m$^2$.

The nonwoven layer can comprise a maximal tensile strength in the machine direction of more than 40 N, in particular of more than 60 N, and/or in the transverse direction of more than 30 N, in particular more than 50 N.

The thickness of the nonwoven layer can be between 0.2 and 1 mm, in particular between 0.4 mm and 0.8 mm.

The nonwoven layer can comprise an air permeability of 40 l/(m$^2$s) to 500 l/(m$^2$s), in particular of 50 l/(m$^2$s) to 300 l/(m$^2$s), in particular of 80 l/(m$^2$s) to 200 l/(m$^2$s).

The penetration of the nonwoven layer can be smaller than 60%, in particular smaller than 50%, in particular smaller than 15%.

As material for the nonwoven layer, basically very diverse plastics come into question. The material can be a polymer, in particular polypropylene, and/or polyester and/or a biodegradable plastic, in particular PLA (polylactic acid, polylactide), and/or polycaprolactone (PCL). The nonwoven layer can consist only of plastics, in particular of biodegradable plastics.

Biodegradable plastics can be removed from the environment by biodegradation and supplied to the mineral cycle of materials. In particular, biodegradable plastics designate plastics which fulfill the criteria of the European Standards EN 13432 and/or EN 14995.

Biodegradable plastics that can be processed to nonwovens are also known, for example, from U.S. Pat. No. 6,207,601 and EP 0 885 321.

The nonwoven layer can be electrostatically charged. The fibers can be electrostatically charged before consolidation, and/or the nonwoven, that means the fibers after consolidation, can be electrostatically charged.

The nonwoven layer can be electrostatically charged by a corona process. In the process, the web is centered in a region of a width of about 3.8 cm (1.5 inches) to 7.6 cm (3 inches) between two d.c. voltage electrodes for corona discharge. Here, one of the electrodes can have a positive direct voltage of 20 to 30 kV, while the second electrode has a negative direct voltage of 20 to 30 kV.

As an alternative or in addition, the nonwoven layer can be electrostatically charged by a method according to the teaching of U.S. Pat. No. 5,401,446.

The vacuum cleaner filter bag can be a flat bag. As an alternative, the vacuum cleaner filter bag can also be a block bottom bag.

The vacuum cleaner filter bag can comprise an admission port through which the air to be purified flows into the filter bag. The filter bag can moreover comprise a holding plate which serves to fix the vacuum cleaner filter bag in a chamber of a vacuum cleaner and which is arranged in the region of the admission port. The holding plate can in particular be made of plastics. The holding plate can be connected with the bag wall and comprise a through hole in the region of the admission port.

The bag wall can comprise a front and a back side which are connected to each other by a surrounding weld seam. The front side and the back side can be rectangular, square or circular. The front side and the back side can consist of an above-described nonwoven layer.

The vacuum cleaner filter bag can be a disposable vacuum cleaner bag.

The above mentioned parameters can in particular be adapted to the size and/or the application of the vacuum cleaner filter bag.

Figure 2:
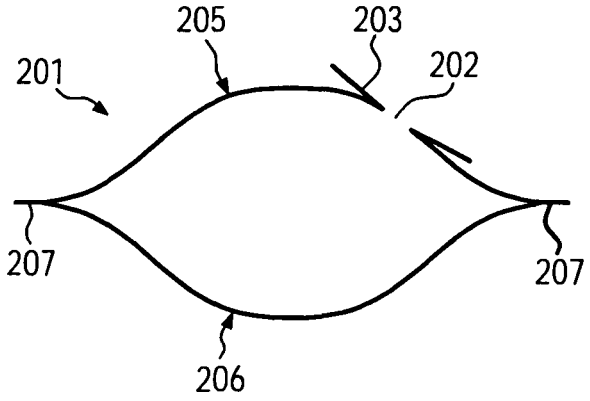
Figure 3:
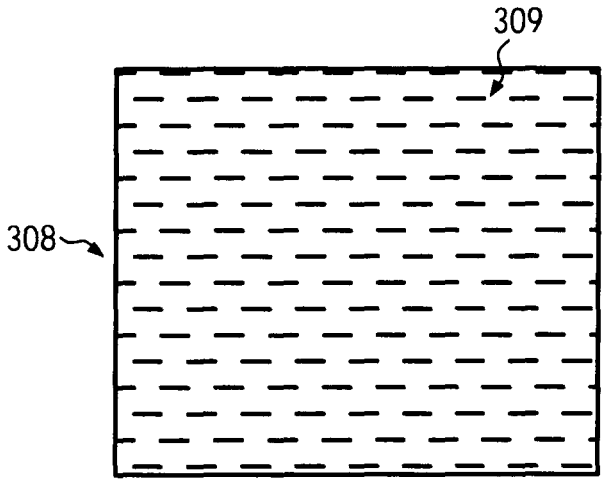

Below, the invention will be described more in detail with reference to examples and the figures. In the drawings:

FIG. 1 schematically shows the design of an exemplary vacuum cleaner filter bag;

FIG. 2 shows a cross-section through an exemplary vacuum cleaner filter bag; and FIG. 3 schematically shows a cutout of the area of the bag wall of an exemplary vacuum cleaner filter bag which allows the passage of a flow.

For the determination of the above parameters and those described below, the following methods are used.

Air permeability is determined according to DIN EN ISO9237:1995-12. In particular, a differential pressure of 200 Pa and a test surface of 20 cm$^2$ are employed. For the determination of air permeability, the air permeability test apparatus FX3300 by Texttest AG was used.

Grammage is determined according to DIN EN 29073-1: 1992-08. For the determination of the thickness of the nonwoven layer, the method according to Standard DIN EN ISO 9073-2: 1997-02 is employed, Method A being used here.

The maximal tensile strength is determined according to DIN EN29073-3: 1992-08. In particular, a strip width of 50 mm is used.

The penetration (NaCl permeability) is determined by means of a TSI 8130 test apparatus. In particular, 0.3 μm sodium chloride is used at 86 l/min.

The measurement of the number density of the weld points is made as follows. First, five partial areas of the bag wall which do not overlap are selected, where each of the partial areas has a size of 10 cm$^2$ and is completely enclosed by a surface of the bag wall which allows the passage of a flow. In other words, none of the partial areas is directly adjacent to the holding plate, the admission port and/or possibly existing weld seams. Each of the partial areas is surrounded by a square of a side length of 3.16 cm. All partial areas can be arranged at the front side or at the back side of the filter bag, or one or several partial areas can be arranged at the front side, and one or several partial areas can be arranged at the back side.

In each of the partial areas, the weld points which are arranged on the partial area are then counted, and for each of the partial areas, the ratio of the number of weld points to the total area of the partial area is obtained. In other words, for each of the partial areas, the number of weld points is divided by 10 cm$^2$. One weld point is arranged on the partial area if at least a portion of the surface of the weld point is located within the square surrounding the partial area.

From the five values obtained in this way, the arithmetic average is then obtained, i.e. the five values are added and then divided by five. The value thus obtained corresponds to the number density of the weld points of the nonwoven layer.

The press area proportion of the weld points is determined as follows. First, five partial areas of the bag wall which do not overlap are selected, where each of the partial areas has a size of 10 $cm^2$ and is completely enclosed by a surface of the bag wall which allows the passage of a flow. In other words, none of the partial areas is directly adjacent to the holding plate, the admission port and/or possibly existing weld seams. Each of the partial areas is surrounded by a square of a side length of 3.16 cm. All partial areas can be arranged at the front side or at the back side of the filter bag, or one or several partial areas can be arranged at the front side, and one or several partial areas can be arranged at the back side.

In each of the partial areas, the total area of the weld points, that means the sum of the weld point areas which are arranged on the partial area, is then determined. The total area of the weld points is determined by means of a measuring microscope and/or by means of image analysis. For each of the partial areas, the ratio of the total surface of the weld points to the total surface of the partial area is then obtained. In other words, for each of the partial areas, the total area of the weld points is divided by 10 $cm^2$. From the five values obtained in this way, the arithmetic average is then obtained, i.e. the five values are added and then divided by five. The value thus obtained corresponds to the press area proportion of the weld points of the nonwoven layer.

FIG. 1 shows the schematic design of an exemplary vacuum cleaner filter bag 101. The filter bag 101 comprises an admission port 102 through which the air to be filtered flows into the filter bag 101. The exemplary filter bag 101 moreover comprises a holding plate 103 which serves to fix the vacuum cleaner filter bag 101 in a chamber of a vacuum cleaner. The holding plate 103 is made of plastics.

Moreover, FIG. 1 shows the bag wall 104, the bag wall 104 comprising precisely one nonwoven layer in the form of a meltblown nonwoven layer. The exemplary filter bag 101 is designed as a flat bag.

The filter bag 101 is single-layered, consisting of a nonwoven layer of meltblown nonwoven) consolidated in points by means of thermal calender consolidation.

The nonwoven layer of the exemplary filter bag 101 consists of PLA (polylactide). PLA can be obtained from Galactic Laboratories (Belgium), Cargill Dow Polymers LLC, Toyobo (Japan), Dai-Nippon etc.

The mass per unit area or the grammage of the exemplary filter bag 101 is 85 $g/m^2$.

The embossing pattern of the bag wall 104 has a density of 25 weld points per $cm^2$. The press area proportion of the embossing pattern is 17%.

With respect to the geometry or the pattern of the welded joints, i.e. the distribution of the welded joints on the area of the bag wall 104 which allows the passage of a flow, the present invention is not subject to any restrictions. The pattern can be, for example, a pattern arranged at an angle of 45° to the machine direction.

Tests by the applicant showed that a meltblown microfibrous nonwoven produced in such a manner achieves sufficient strength with a satisfactory filtration efficiency and air permeability.

In some markets, there is a demand for disposable vacuum cleaner bags which are replaced already after a short period of application, for example after some days. In particular in case of a high humidity of the air and high temperatures, a storage of the bag with the sucked-in dust should be preferably avoided as otherwise a proliferation of mould fungi and bacteria in the filter bag can inevitably constitute a hygienic problem under these conditions. Filter bags of multilayer nonwovens are usually too expensive for such short-time applications.

A single-layer filter bag, as, for example, the exemplary filter bag 101 described in connection with FIG. 1, can be manufactured and sold at lower costs and is therefore better suited for such a short service life.

FIG. 2 shows a cross-section of an exemplary filter bag 201. The filter bag 201 comprises a front side 205 and a back side 206 which are connected to each other by a surrounding weld seam 207. In the front side 205 of the filter bag 201, an admission port 202 is provided through which the sucked-in air can flow into the filter bag 201. A holding plate 203 serving for fixing the vacuum cleaner filter bag 201 in a chamber of a vacuum cleaner is arranged in the region of the admission port 202 and connected to the bag wall of the filter bag 201.

A cutout 308 of the bag wall of an exemplary filter bag is shown in FIG. 3. The exemplary cutout 308 of the bag wall comprises a plurality of welded joints or weld points 309 which have been formed by thermal calender consolidation on an embossing calender. The weld points 309 correspond to weld zone areas.

The embossing pattern has a density of 25 weld points per $cm^2$. The press area proportion of the embossing pattern is 17%. The weld points are in this example uniformly, i.e. at equal distances, distributed across the exemplary cutout 308 of the bag wall.

The weld points can in particular be distributed all-over the total area of the bag wall which allows the passage of a flow. All-over does not mean in this connection that all fibers are completely connected, for example melted, to each other, which would result in a film. It rather means that the nonwoven layer is welded at a plurality of discrete points, these points being uniformly distributed across the total area of the nonwoven layer. The points can be predetermined, for example in case of a punctiform or engraving calender.

In the following table, exemplary properties of nonwovens are compared, nonwovens 1 and 2 corresponding to prior art and nonwovens 3 and 4 being nonwovens according to the invention.

| | Non-woven 1 | Non-woven 2 | Non-woven 3 | Non-woven 4 |
|---|---|---|---|---|
| Pressing area [%] | none | none | 20 | 17 |
| Weld points [Points/$cm^2$] | none | none | 25 | 30 |
| Mass per unit area [$g/m^2$] | 85 | 100 | 86 | 89 |
| Thickness [mm] | 1.2 | 0.99 | 0.65 | 0.62 |
| Air permeability [$l/(m^2s)$] | 210 | 213 | 130 | 134 |
| Maximal tensile strength in the machine direction [N] | 31 | 31 | 101 | 98 |
| Maximal tensile strength transverse to the machine direction [N] | 19 | 10 | 86 | 60 |
| Penetration (TSI 8130, 0.3 μm, 86 l/min [%] | 5.5 (corona charged) | 48 (un-charged) | 44 (un-charged) | 46 (un-charged) 16 (corona charged |

All nonwovens shown in the table consist of polypropylene and are meltblown nonwovens. The exemplary nonwoven 3 was in particular biaxially oriented.

It will be understood that features mentioned in the above described embodiments are not restricted to these special combinations and are also possible in any other combinations. It will be furthermore understood that in the figures, neither the shown vacuum cleaner filter bag is represented in realistic dimensions, nor the shown welded joints are represented in a realistic distribution and number density.

The invention claimed is:

1. A vacuum cleaner filter bag with a bag wall, wherein the bag wall comprises precisely one nonwoven layer in the form of a meltblown nonwoven layer, wherein the meltblown nonwoven layer comprises a maximal tensile strength in a machine direction of more than 40 N.

2. The vacuum cleaner filter bag according to claim 1, wherein the bag wall consists of a nonwoven layer in the form of a meltblown nonwoven layer.

3. The vacuum cleaner filter bag according to claim 1, wherein the nonwoven is a calendered nonwoven.

4. The vacuum cleaner filter bag according to claim 3, wherein a press area proportion of the calendered nonwoven is 3% to 50%.

5. The vacuum cleaner filter bag according to claim 3, wherein the nonwoven layer comprises a number density of weld points from $5/cm^2$ to $50/cm^2$.

6. The vacuum cleaner filter bag according to claim 1, wherein the nonwoven layer has a grammage of 30 $g/m^2$ to 200 $g/m^2$.

7. The vacuum cleaner filter bag according to claim 1, wherein the nonwoven layer comprises a maximal tensile strength in a transverse direction of more than 30 N.

8. The vacuum cleaner filter bag according to claim 1, wherein a thickness of the nonwoven layer is between 0.2 mm and 1.0 mm.

9. The vacuum cleaner filter bag according to claim 1, wherein the nonwoven layer comprises an air permeability of 40 $l/(m^2s)$ to 500 $l/(m^2s)$.

10. The vacuum cleaner filter bag according to claim 1, wherein a penetration of the nonwoven layer is smaller than 60%.

11. The vacuum cleaner filter bag according to claim 1, wherein the nonwoven comprises a polymer or a biodegradable plastic.

12. The vacuum cleaner filter bag according to claim 1, wherein the nonwoven layer is electrostatically charged.

13. The vacuum cleaner filter bag according to claim 1, wherein the vacuum cleaner filter bag is a flat bag.

14. The vacuum cleaner bag according to claim 3, wherein the calendered nonwoven comprises a nonwoven calendered thermally or by ultrasound.

15. The vacuum cleaner bag according to claim 4, wherein the press area proportion is 10% to 30%.

16. The vacuum cleaner bag according to claim 5, wherein the number density of weld points is from $15/cm^2$ to $40/cm^2$.

17. The vacuum cleaner bag according to claim 1, wherein the nonwoven layer has a grammage of 40 $g/m^2$ to 150 $g/m^2$.

18. The vacuum cleaner bag according to claim 1, wherein the nonwoven layer comprises a maximal tensile strength in a machine direction of more than 60 N or in a transverse direction of more than 50 N.

19. The vacuum cleaner bag according to claim 1, wherein a thickness of the nonwoven layer is between 0.4 mm and 0.8 mm.

20. The vacuum cleaner bag according to claim 1, wherein the nonwoven comprises polypropylene or PLA (polylactide).

* * * * *